United States Patent [19]

Goodney et al.

[11] 4,139,066

[45] Feb. 13, 1979

[54] HYDRAULIC TILT AND PITCH CONTROL FOR DOZER BLADE

[75] Inventors: Thomas O. Goodney, Platteville, Wis.; Donald O. Johannsen, Sherrill; John T. Kubesheski, Dubuque, both of Iowa

[73] Assignee: Deere & Company, Moline, Ill.

[21] Appl. No.: 804,788

[22] Filed: Jun. 8, 1977

[51] Int. Cl.[2] ..... E02F 3/76

[52] U.S. Cl. ..... 172/803

[58] Field of Search ..... 37/DIG. 7; 172/803, 172/804, 807, 809

[56] References Cited

U.S. PATENT DOCUMENTS

| | | | |
|---|---|---|---|
| 2,817,168 | 12/1957 | Mullin | 172/777 |
| 2,942,363 | 6/1960 | Long | 172/803 |
| 3,184,869 | 5/1965 | Olsen | 172/803 |
| 3,441,092 | 4/1969 | Drone | 172/803 |
| 3,700,044 | 10/1972 | Berg | 172/804 |

*Primary Examiner*—Richard J. Johnson

[57] ABSTRACT

A hydraulic control is provided for selectively effecting tilt and pitch movement of a dozer blade via selected operation of tilt and pitch control valves which are connected in parallel with each other in two conduit networks, the first being connected to a source of fluid under pressure and respective first work ports of a pair of double-acting hydraulic actuators and the second being connected to a reservoir and to respective second work ports of the actuators. A rotary flow divider is connected in the first conduit network so as to effect equal flow to and from the actuators during operation of the pitch valve and so as to prevent flow between the first work ports of the actuators.

4 Claims, 2 Drawing Figures

HYDRAULIC TILT AND PITCH CONTROL FOR DOZER BLADE

BACKGROUND OF THE INVENTION

The present invention relates to hydraulic control systems and more particularly relates to such system for controlling pitch and tilt movement of the working blades of bulldozers, or the like.

It is known to provide a tractor with a pair of fore-and-aft extending push arms having their rear ends pivotally connected to opposite sides of the tractor frame and hving their forward ends pivotally connected to a dozer blade such as to define a transverse axis about which the blade may be selectively adjusted by means of a pair of extensible and retractable hydraulic actuators respectively mounted between the blade and the pair of push arms. Such a push arm and blade structure is disclosed in U.S. Pat. 2,817,168 issued to Mullin on Dec. 24, 1957.

The Mullin patent describes a control system which includes a separate valve for controlling each of the pair of actuators and a separate lever for controlling each of the pair of valves. Thus, both valves must be simultaneously actuated in the same direction to cause simultaneous retraction or extension of the actuators so as to effect a pitch movement of the blade. This operation is not entirely satisfactory since it requires a good deal of operator skill to operate the levers connected to the valves so as to cause equal displacement of the actuators so as to effect a pitch movement of the blade without also effecting a tilt movement of the blade.

The aforementioned problem of unequal actuator displacement during pitch adjustment of the blade is overcome by the structure disclosed in U.S. Pat. No. 3,184,869 issued to Olsen on May 25, 1965. As disclosed in the Olsen patent, the control system includes a single pitch control valve for both actuators, the latter being connected in parallel with each other. A 50/50 rotary flow divider is connected between the valve and the actuators for ensuring equal flow to and from the actuators when the pitch control valve is actuated. For the purpose of causing tilt adjustments of the blade, a reversing valve is placed between the flow divider and one of the actuators and operable such as to cause one actuator to extend or to retract respectively when the pitch control valve is operated to cause the other actuator to retract or extend. This system is not entirely satisfactory since it requires the operator to shift the reversing valve in order to change the system between blade-tilt and blade-pitch modes.

SUMMARY OF THE INVENTION

According to the present invention, there is provided a hydraulic control system which represents an improvement over the system disclosed in aforementioned Olsen patent.

A broad object of the invention is to provide a system, of the type discussed above, which is of simple construction and which can be easily controlled by an operator for accurately and confidently adjusting a dozer blade.

A more specific object is to provide a control system, as discussed hereinabove, having separately controllable pitch and tilt control valves.

Yet another object is to provide a control system as described in the immediately preceding object wherein a flow divider is positioned to ensure equal displacement of the actuators during actuation of the pitch control valve, for preventing movement of one actuator during actuation of the other through actuation of the tilt control valve and for acting in conjunction with the tilt and pitch control valves to block movement of both actuators when the control valves are in their respective centered positions.

These and other objects will become apparent from reading the ensuing description together with the appended drawings.

DESCRIPTION OF THE PREFERRED EMBODIMENT

Figure 1:
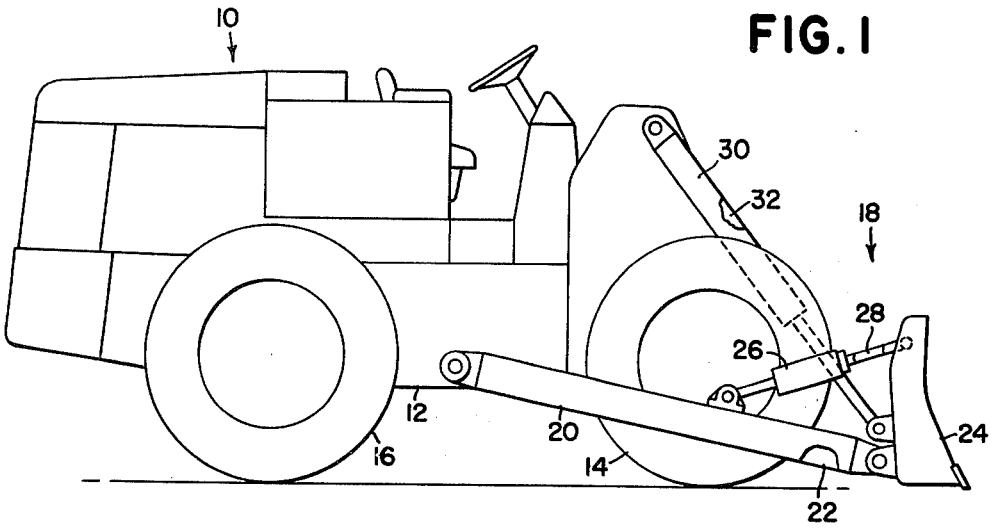
FIG. 1 is a right side elevational view of a tractor having a dozer blade mounted thereon in a manner conductive to being controlled by the present invention.

Referring now to FIG. 1 therein is shown a tractor 10 including a frame 12 and front and rear sets (only one of each set shown) of ground wheels 14 and 16. A dozer assembly 18 is mounted to the frame 12 and includes right and left push arms 20 and 22 having respective rear ends pivotally connected to the frame 12. A dozer blade 24 extends transversely in front of the tractor 10 and is pivotally connected to the forward ends of the arms 20 and 22. Mounted between the blade 24 and the arms 20 and 22 are right and left extensible and retractable hydraulic actuators 26 and 28, respectively, which are selectively operable, in a manner described hereinafter, to effect tilt and pitch movements of the blade 24. Right and left extensible and retractable hydraulic lift actuators 30 and 32 are mounted between an upper forward location of the tractor and the blade 24 and are selectively operable for effecting raising and lowering of the blade 24 and, thus, raising and lowering of the arms 20 and 22.

Figure 2:
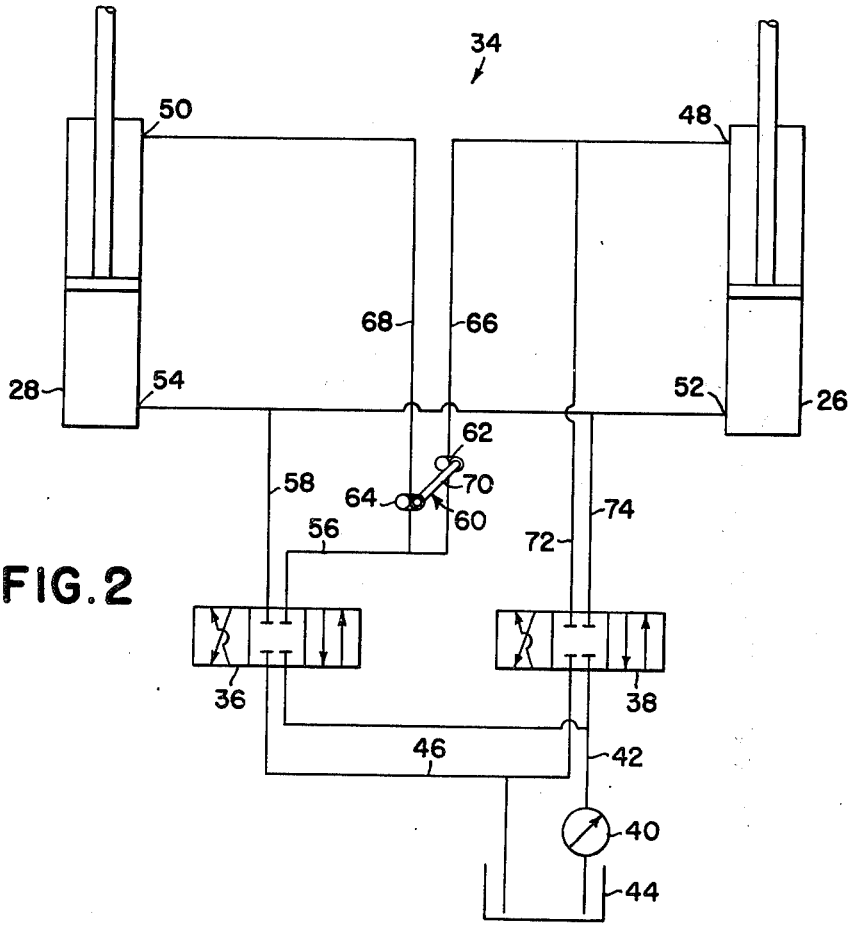
FIG. 2 is a schematic view of a hydraulic system constructed according to the principles of the present invention.

Referring now to FIG. 2, therein is shown a hydraulic system 34 for controlling the actuators 26 and 28. Specifically, therein is shown a pitch control valve 36 and a tilt control valve 38, the valves 36 and 38 being connected to a variable displacement pump 40 by means of a branched supply line 42 and to a reservoir 44 by means of a branched return line 46. The actuators 26 and 28 respectively have first work ports 48 and 50 at their rod ends and respectively have second work ports 52 and 54 at their head ends. A first branched supply-return line 56 is connected between the pitch control valve 36 and the first work ports 48 and 50 while a second branched supply-return line 58 is connected between the pitch control valve 36 and the second work ports 52 and 54. A rotary 50/50 flow divider 60 is mounted in the first branched supply-return line 56 and includes first and second gear pumps 62 and 64 respectively located in first and second branches 66 and 68 of the line 56. The pumps 62 and 64 are joined by a drive shaft 70 which causes them to operate in unison to ensure equal, concurrent flow to or from the work ports 48 and 50 via the branches 66 and 68 when the pitch control valve 36 is operated but to prevent flow between the ports 48 and 50 when the pitch control valve 36 is in its neutral position, as shown.

The tilt control valve 38 is connected to work ports 48 and 52 by connection lines 72 and 74, respectively. It is important to note that the connection line 72 joins the branch 66 of the line 56 at a location between the flow divider 60 and the work port 48 since, with this disposition of the connection, the flow divider isolates the actuator 28 from the actuator 26 such that operation of the latter by means of the tilt control valve 38 has no effect on the actuator 28.

It will be readily recognized that while the hydraulic system disclosed is depicted as a closed center system, the principles of the invention may be easily embodied in an open center system.

The operation of the hydraulic control system 34 is as follows Assuming the pitch and tilt control valves 36 and 38 to be in their respective centered positions, as illustrated, each will block fluid communication between the actuators 26 and 28 and the pump 40 and reservoir 44.

If it is desired to pitch the blade 24 clockwise about its connections with the push arms 20 and 22, the operator needs only to shift the pitch control valve 36 to the right, as viewed in FIG. 2 to connect the pump 40 to the line 58 and the reservoir 44 to the line 56. Pressure fluid in the line 58 will act to extend the actuators 26 and 28 and force fluid in the rod ends thereof through the gear pumps 62 and 64 of the flow divider 60, the latter ensuring an equal flow from the actuators 26 and 28 and in that way ensuring equal extension of the actuators regardless of whether or not an unbalanced load may exist across the length of the blade 24.

Pitching of the blade 24 in a counterclockwise direction about its connection with the arms 20 and 22 may be accomplished by contracting the actuators 26 and 28 by moving the valve 36 leftwardly from its centered position to a second active position wherein the lines 56 and 58 are respectively connected to the pump 40 and reservoir 44. The flow of pressure fluid to the actuators 26 and 28 is then equalized by the flow divider 60 to effect simultaneous, equal contraction of the actuator 26 and 28.

The blade 24 may be tilted to slant downwardly from right to left by extending the actuator 26 relative to the actuator 28. This is done by shifting the tilt control valve 38 leftwardly, from its illustrated centered position, to connect the line 74 to the pump 40 and the line 72 to the reservoir 44. Tilting of the blade 24 in the opposite direction is effected by contracting the actuator 26 and this is accomplished by shifting the tilt control valve 38 rightwardly from its centered position to thereby connect the line 72 to the pump 40 and the line 74 to the reservoir 44.

During operation of the actuator 26 by means of the tilt control valve 38, the actuator 28 remains hydraulically locked since the rotary flow divider 60 acts to prevent flow therefrom by virtue of the interconnected gear pumps 62 and 64.

When control valves 36 and 38 are in the centered position the rotary flow divider blocks fluid communication between actuator ports 48 and 50 thereby locking actuators 26 and 28 in position. It is also to be recognized that the functions of the hydraulic system 34 is not changed if the flow divider 60 is placed in branched line 58 rather than branched line 56.

It will thus be appreciated that applicants have provided a simple hydraulic system for controlling pitch and tilt movements of a dozer blade.

We claim:

1. A hydraulic system for controlling tilt and pitch movements of a dozer blade, comprising: first and second extensible and retractable hydraulic actuators which each include first and second work ports; a first pressure-return line means having first and second branches respectively coupled to the first work ports of the first and second actuators; a second pressure-return line means having first and second branches repectivley coupled to the second work ports of the first and second actuators; a source of fluid pressure; a reservoir; a pitch control valve means connected to the first and second pressure-return line means, the source and the reservoir and being selectively shiftable among neutral and first and second operative positions for respectively blocking the source and reservoir from the first and second pressure-return line means and for simultaneously connecting the first and second pressure-return line means respectively to the source and reservoir and vice versa; a flow divider valve means connected in the first and second branches of the first pressure-return line means and being operative for effecting simultaneous equal flow to and from the first work ports when the pitch control valve means is in one of its operative positions and for blocking flow between the first work ports when the control valve is in its neutral position; third and fourth pressure-return line means respectively connected to the first and second work ports of the second actuator; a tilt control valve means connected to the third and fourth pressure-return line means and to said source and reservoir and being selectively shiftable among neutral and first and second operative positions for respectively blocking the source of fluid pressure and the reservoir from the third and fourth pressure-return line means and for simultaneously connecting the third and fourth pressure-return line means respectively to the source and reservoir and vice versa.

2. The hydraulic system defined in claim 1 wherein the flow divider valve means is a rotary flow divider including first and second gear pumps respectively located in said first and second branches of the first pressure-return line means; and said pumps including a common drive shaft for effecting thereon flow to or away from the first work ports of the first and second actuators via the first and second branches of the first pressure-return line means.

3. In a hydraulic system for controlling tilt and pitch movements of a dozer blade and including first and second extensible and retractable hydraulic actuators connected in parrallel with each other and each having first and second work ports, a source of fluid under pressure, a reservoir, valving connected to the first and second work ports of each of the first and second actuators and to the source and reservoir and being selectively operable for establishing a neutral condition wherein fluid is prevented from passing to or from the actuators, a pitch effecting condition wherein the source and reservoir are connected to the actuators such as to effect either concurrent equal extension or retraction of the actuators and a tilt effecting condition wherein the source and reservoir are connected to the actuators such as to effect extension or retraction of one actuator relative to the other, an improved valving arrangement comprising: separately operable tilt and pitch control valves and a flow divider means; first and second conduit means respectively connecting the pitch control valve to the first work ports and the second work ports of the first and second actuators; said first conduit means having a separate branch leading to each actuator and said flow divider means being connected in each branch and operative for permitting equal concurrent flow in the branches either to or away from the actuators and for preventing flow therethrough from one actuator to the other; third and fourth conduit means respectively connecting the tilt control valve to the first conduit means, at a location between the flow divider means and one of the actuators, and to the second conduit means; and supply and return conduit means respectively connected to the source and reservoir and to the tilt and pitch control valves.

4. The hydraulic system defined in claim 3 wherein the flow divider means is a rotary flow divider including a pair of gear pumps respectively located in the separate branches of the first conduit means and coupled together for operation in unison by a drive shaft.

* * * * *

UNITED STATES PATENT OFFICE

CERTIFICATE OF CORRECTION

Patent No. 4,139,066 Dated 13 February 1979

Inventor(s) Thomas O. Goodney, Donald O. Johannsen and John Theodore Kubesheski

It is certified that error appears in the above-identified patent and that said Letters Patent are hereby corrected as shown below:

Column 4, line 6, delete "repectivley" and insert -- respectively --.

Column 4, line 23, after "valve" insert -- means --.

Column 4, line 47 delete "parrallel" and insert -- parallel --.

Signed and Sealed this

*Seventeenth* Day of *June 1980*

[SEAL]

*Attest:*

SIDNEY A. DIAMOND

*Attesting Officer*

*Commissioner of Patents and Trademarks*